US008403626B2

(12) United States Patent
Hasselqvist et al.

(10) Patent No.: US 8,403,626 B2
(45) Date of Patent: Mar. 26, 2013

(54) ARRANGEMENT FOR A GAS TURBINE ENGINE

(75) Inventors: Magnus Hasselqvist, Finspong (SE); Peter Senior, Levittown, PA (US)

(73) Assignee: Siemens Aktiengesellschaft, München (DE)

( * ) Notice: Subject to any disclaimer, the term of this patent is extended or adjusted under 35 U.S.C. 154(b) by 769 days.

(21) Appl. No.: 12/529,345

(22) PCT Filed: Feb. 29, 2008

(86) PCT No.: PCT/EP2008/052518

§ 371 (c)(1),
(2), (4) Date: Sep. 1, 2009

(87) PCT Pub. No.: WO2008/107401

PCT Pub. Date: Sep. 12, 2008

(65) Prior Publication Data

US 2010/0104432 A1 Apr. 29, 2010

(30) Foreign Application Priority Data

Mar. 6, 2007 (EP) ..... 07004590

(51) Int. Cl.
*F01D 1/04* (2006.01)
*F01D 5/06* (2006.01)
*F03B 3/04* (2006.01)

(52) U.S. Cl. ..... 415/91; 416/97 R

(58) Field of Classification Search ..... 415/115, 415/191, 211.2, 208.1, 208.2, 210.1; 416/97 R, 416/96 R, 233, 244; 29/889.21, 889.22, 29/527.3, 527.5

See application file for complete search history.

(56) References Cited

U.S. PATENT DOCUMENTS

| | | | | |
|---|---|---|---|---|
| 3,233,866 | A | 2/1966 | Davidovic | |
| 4,827,588 | A | 5/1989 | Meyer | |
| 5,419,039 | A | 5/1995 | Auxier et al. | |
| 5,820,337 | A | 10/1998 | Jackson et al. | |
| 6,264,426 | B1 * | 7/2001 | Fukuno et al. | 415/115 |
| 7,093,359 | B2 * | 8/2006 | Morrison et al. | 29/889.71 |
| 7,200,933 | B2 * | 4/2007 | Lundgren et al. | 29/889.22 |
| 7,322,796 | B2 * | 1/2008 | Pietraszkiewicz et al. | 29/889.22 |
| 7,389,583 | B2 * | 6/2008 | Lundgren | 29/889.22 |
| 2005/0076504 | A1 | 4/2005 | Morrison et al. | |
| 2006/0120869 | A1 * | 6/2006 | Wilson et al. | 416/97 R |

FOREIGN PATENT DOCUMENTS

| | | | |
|---|---|---|---|
| CA | 2557236 | A1 | 2/2007 |
| CA | 2558479 | A1 | 2/2007 |
| EP | 1239120 | A2 | 9/2002 |
| GB | 585335 | | 2/1947 |
| JP | 01313602 | A | 12/1989 |
| JP | 9280004 | A | 10/1997 |

(Continued)

*Primary Examiner* — Edward Look
*Assistant Examiner* — Woody A Lee, Jr.

(57) ABSTRACT

An inlet guide vane arrangement for a gas turbine is provided. The arrangement includes a plurality of guide vane duct elements, the guide vane duct elements include a suction side wall and a pressure side wall, both walls facing each other, and are designed to be adjoinable to another of the guide vane duct elements, such that the pressure side wall of one guide vane duct element cooperates with the suction side wall of the adjacent guide vane duct element thereby forming a guide vane. The guide vane duct element includes features to accept a key element adapted to be arranged between the pressure side wall and the adjacent suction side wall, when two guide vane duct elements are adjoining to one another, and to attach together both adjoining guide vane duct elements.

18 Claims, 4 Drawing Sheets

FOREIGN PATENT DOCUMENTS

| | | | |
|---|---|---|---|
| JP | 10220203 | A | 8/1998 |
| WO | WO 2004/016910 | A1 | 2/2004 |
| WO | WO 2004/083605 | A1 | 9/2004 |

* cited by examiner

ARRANGEMENT FOR A GAS TURBINE ENGINE

CROSS REFERENCE TO RELATED APPLICATIONS

This application is the U.S. National Stage of International Application No. PCT/EP2008/052518, filed Feb. 29, 2008 and claims the benefit thereof. The International Application claims the benefits of European Patent Office application No. 07004590.1 EP filed Mar. 6, 2007, both of the applications are incorporated by reference herein in their entirety.

FIELD OF INVENTION

The invention relates to an inlet guide vane arrangement for a gas turbine engine.

BACKGROUND OF THE INVENTION

Blades, in particular stator vanes, in a gas turbine engine, in particular in an axial-flow gas generator turbine, are subjected to mechanical and thermal loads during operation of the turbine. The thermal and mechanical loads are caused by hot gas flow heating up the vanes and applying gas forces to the vanes. In particular the first nozzle guide vanes immediately downstream of a combustor of the gas generator experience hot gas temperatures.

High demands are made on design and construction of vanes having sufficient mechanical integrity in order to withstand applied loads during operation.

Further, the integrity of the vanes also depends on the life endurance of the vanes. In particular, when a vane is subjected to a high temperature in combination with a high strain for a long period, creeping of the vane can occur resulting in cracks in the vane material and finally in mechanical failure.

The strength of the vane material is dependent on stresses applied during operation, operation temperature and operation time. In order to improve the mechanical integrity and life endurance of the vane it is a common remedy to cool down the vane material.

The vane is provided with internal cooling passages through which cooling air is flowing. The cooling air is extracted from a compressor of the gas generator which represents a significant efficiency and power output penalty.

A guide vane assembly of the gas generator turbine is comprised by a plurality of guide vane sections attached to one another. Each guide vane assembly comprises the vane and a hub portion and a shroud portion. Each hub portion of one guide vane section is abutting the hub portion of the adjacent guide vane section thereby forming a hub of the guide vane assembly. Each shroud portion of one guide vane section is abutting the shroud portion of the adjacent guide vane section thereby forming a casing of the guide vane assembly.

The partition of the guide vane assembly into guide vane sections is uniform such that each guide vane section is identical in its geometry and dimensions. Therefore, each guide vane section can be manufactured similarly. It is common to manufacture the guide vane sections by casting.

However, for cooling purposes the guide vanes of the guide vane assembly are provided with internal cooling passages. Since the geometrical dimensions of the guide vanes are small, it is difficult to manufacture the internal cooling passages within the interior of the guide vane material with respect to accuracy and reasonable manufacturing cost.

Given that the gas temperature experienced by the vanes in a modern gas turbine can reach or even exceed 80% of the melting temperature of the available nickel alloy materials, current technologies which rely upon casting internal cooling passages have been refined to a very high level. A principal barrier is the practical accuracy with which internally cast cooling features can be manufactured, especially in alloys with very advanced microstructure such as directionally solidified and single crystal materials. This tends both to reduce the efficiency of the cooling and result in larger passages which waste air to the detriment of the machine performance.

Furthermore, inaccuracies in casting mean that the cooling air distribution is usually far from even around the gas turbine, meaning that the design of the nozzle guide vane has to be set out for the worst case, and results in wasted air for almost all other nozzle guide vanes. This is particularly acute for small gas turbine engines, where casting tolerances are a much larger fraction of the part and passage size. This also means that the average wall thickness has to be greater than desirable to avoid weakness in the worst case. This results in greater thermal resistance and thus again reduces cooling efficiency.

It is an objective of the invention to provide an inlet guide vane arrangement for a gas turbine engine, wherein the guide vane duct element has a high cooling efficiency and nevertheless can be manufactured easily with high accuracy.

SUMMARY OF THE INVENTION

According to the invention, this objective is achieved by an inlet guide vane arrangement for a gas turbine engine as claimed in the claims. The depending claims define further developments of the invention.

An inventive inlet guide vane arrangement for a gas turbine engine comprises plurality of guide vane duct elements, the guide vane duct elements comprising a suction side wall and a pressure side wall, both walls facing each other, and being designed to be adjoinable to one another of said guide vane duct elements, such that the pressure side wall of one guide vane duct element cooperates with the suction side wall of the adjacent guide vane duct element thereby forming a guide vane. Further, the guide vane duct element includes features to accept a key element adapted to be arranged between the pressure side wall and the adjacent suction side wall, so that, when two guide vane duct elements are adjoining to one another, the key fixes together both adjoining guide vane duct elements.

The guide vane duct element defines a flow passage limited by the suction side wall and the pressure side wall. When arranging a plurality of said guide vane duct elements side by side a guide vane arrangement is formed, wherein pairs defined by adjacent pressure side walls and suction side walls form relevant guide vanes. In case a predetermined number of guide vane duct elements are arranged to one another of said guide vane duct elements, a guide vane arrangement is formed.

Since the guide vane is formed by the pressure side wall of one guide vane duct element and the suction side wall of the adjacent guide vane duct element, the guide vane is defined by two individual guide vane duct elements. Therefore, within the guide vane a partition face is provided and when having separated two adjacent guide vane duct elements, the interior of the guide vane is accessible from the outside.

Therefore, when manufacturing the guide vane duct element, the flow passage between the suction side wall and the pressure side wall is manufactured internally, whereas the partition face of the guide vane is exposed to the outside. For example, the guide vane duct element can be manufactured by casting, wherein the flow passage with its suction side wall and pressure side wall is formed using a core, and by machining the partition face, for example, the internal cooling passages within the guide vane are manufactured.

The geometrical dimensions of the flow passage is much larger compared with the geometrical dimensions of the cooling passages. In general, machining allows smaller manufacturing tolerances compared with casting. Therefore, it is appropriate to manufacture the flow passage by means of the moulding core and the cooling passage by machining, since the casting tolerances of the flow passage have a similar relative effect to a main flow than the machining tolerances of the cooling passage to the cooling flow. Further, the mould core for a main flow passage is less complex, larger and more stable leading to a high manufacturing yield. Additionally, the ability to accurately gauge the position of the cooling passage of the guide vane leads to the fact that by machining the partition face misalignment of the core and mould can be corrected resulting in a lower scatter and thus design margins for both the cooling passage and the flow passage and the thickness tolerance of both the suction side wall and the pressure side wall can be tightened. As a consequence of this, the quantity of necessary cooling air can be reduced which increases the general efficiency of the gas turbine engine.

The guide vane duct element may comprise a hub segment wall and a shroud segment wall facing each other and forming a hub or a shroud of the guide vane row, respectively, when multiple guide vane duct elements are arranged one another.

Therefore, the guide vane duct element has a box like structure defined by the suction side wall, the pressure side wall, the hub segment wall and the shroud segment wall. This box like structure is rigid and has high mechanical strength and stiffness.

Further, it is advantageous that both the hub segment wall and the shroud segment wall have a predetermined extension upstream of the leading edge of the guide vane and downstream of the trailing edge.

In general, the gas turbine engine comprises a combustion chamber with a transition zone. Therefore, when the guide vane duct element is mounted into the gas turbine engine proximately downstream of the combustion chamber, the predetermined extensions are advantageously dimensioned to extend at least until to the transition zone. In a conventional design the joint between guide vanes runs from the upstream edge of the vane row to the downstream edge, exposed to the duct flow all along this length. Typically leakage must be provided hot gas entering the joint and damage the vane support structure. In the inventive design bulk of the joint between the vanes lies between suction and pressure surfaces, thus is not exposed hot gas in the turbine. Therefore, a joint leak in the hub side wall and the shroud side wall is reduced in length to upstream and downstream extensions. This joint is currently notorious for leakage and wasted cooling air, as well as disturbing the aerodynamics in the turbine reducing the aerodynamic efficiency.

This implementation would also fit well with a pressure loss cooling scheme which would permit the guide vane cooling air to be reused in the combustor chamber. This would raise the thermodynamic effective firing temperature of the turbine without changing the physical hottest gas temperature which is materials and emissions limited. The consequence is an improved gas turbine engine output and efficiency for any given material technology. This would also allow the first vane to be supported from the combustor. By supporting the guide vane from the combustor chamber in this way, a significant fraction of the turbine mechanics can be saved for reduced cost. Combined with a can-type system designed to allow the transition ducts to be removed via the centre casing, this approach could also permit very rapid inspection and replacement of the hottest blading, giving a further planned downtime advantage.

Preferably the guide vane duct element is made of a high temperature material, in particular a ceramic material or a refractory metal alloy.

The use of high temperature materials allows increasing the combustion discharge temperature thereby increasing the thermodynamic efficiency of the gas generator.

For a common guide vane made of these high temperature materials it is difficult or even impossible for certain configurations to form the cooling passage into the guide vane. However, the provision of the guide vane duct element allows its partition faces at the pressure side wall and the suction side wall to comprise the cooling passage, although the geometry of the guide vane duct element remains simple. More complex geometries for the cooling passage can be envisaged by machining or a combination of casting and machining. The complex geometries permit more effective use of coolant like cooling air giving a lower vane temperature and/or reduced coolant usage.

Alternatively, for lower temperature the guide vanes further downstream the duct element may be manufactured by pressing or forging it out of a sheet or plate material either preformed as a single piece, e.g. as conical tube, or in two halves which are subsequently joined together.

The two halves may be joined together by a fusion weld.

In particular, the two halves may be joined together on the hub segment wall and the shroud segment wall between the suction side wall and the pressure side wall.

Such manufacturing of the guide vane duct element reduces the production lead-time, and permits the use of forged material with enhanced machining strength.

Further, it is possible that the guide vane duct element is provided with coating.

Advantageously, the surface of the guide vane duct element can be separately masked off for coating, allowing predetermined coating compositions to be used for the different duties at the surfaces exposed to cooling air and the surfaces exposed to hot gas. In case of a cooling passage opening on the suction side wall surface or on the pressure side wall surface into the flow passage with cooling holes, advantageously during refurbishment, the flow passage can be recoated and then the cooling passage can be re-eroded from the "back" cooled surface following their existing path to remove any blockage and ensure that the debris does not foul the cooling passage.

Furthermore, it is advantageous for flow uniformity that the access for penetrating cooling holes is improved and allows deburring and eliminating burrs within the cooling passage, which are inaccessible in the prior art.

Preferably, the guide vane comprises, when assembled, a hollow interior adapted for air cooling, wherein, in particular, the interior is provided with turbulators.

Furthermore, it is preferred that the key element is adapted to be fixable to the pressure side wall and the corresponding suction side wall by form fit, eliminating the need for threaded fixings on each blade.

Advantageously, the key element is provided with turbulators and/or with an impingement tube, made easier by the fact that the key can be made of softer materials then the guide vane duct elements since it does not have to contact hot gas.

It is preferred that, when two guide vane duct elements are adjoining to one another, by the pressure side wall of one guide vane duct element and the suction side wall of the adjacent guide vane duct element at the leading edge and/or at the trailing edge a partitioning line is defined comprising at least one leading edge opening and/or at least one trailing edge opening, respectively.

It is advantageous if the form of the joint between adjacent guide vanes elements is designed such that leading edge openings and/or trailing edge openings form a series of discrete holes for the discharge of cooling air into the mainstream.

Further, it is preferred that, the key element is adapted to distance the pressure side wall from the adjacent suction side wall such that the at least one leading edge opening and/or the at least one trailing edge opening are formed as aerodynamic slot being permeable between the flow passage and the interior and attaching the exhausting coolant as a film on the gas exposed walls of the guide vane elements.

The vanes of the inventive arrangement may be attached to the combustor exit.

BRIEF DESCRIPTIONS OF THE DRAWINGS

In the following the invention is explained on the basis of a preferred embodiment of the guide vane duct element with reference to the drawings. In the drawings.

Figure 3:
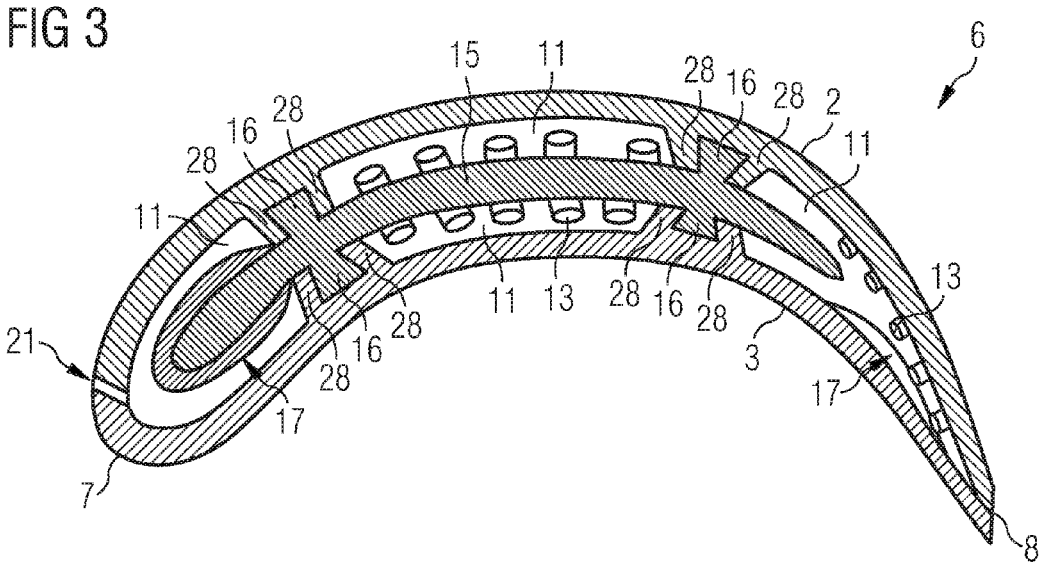
Figure 4:
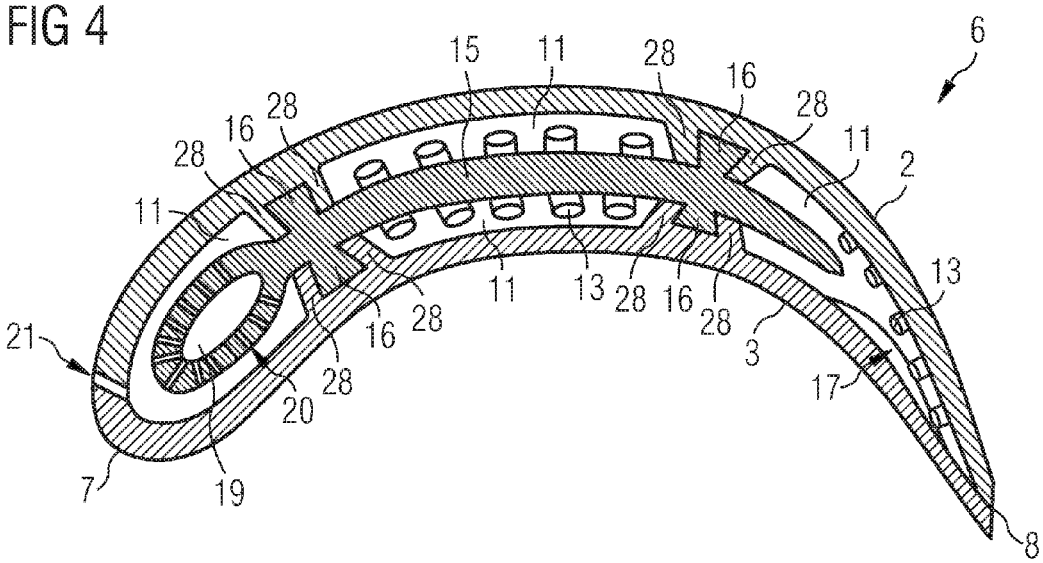
Figure 5:
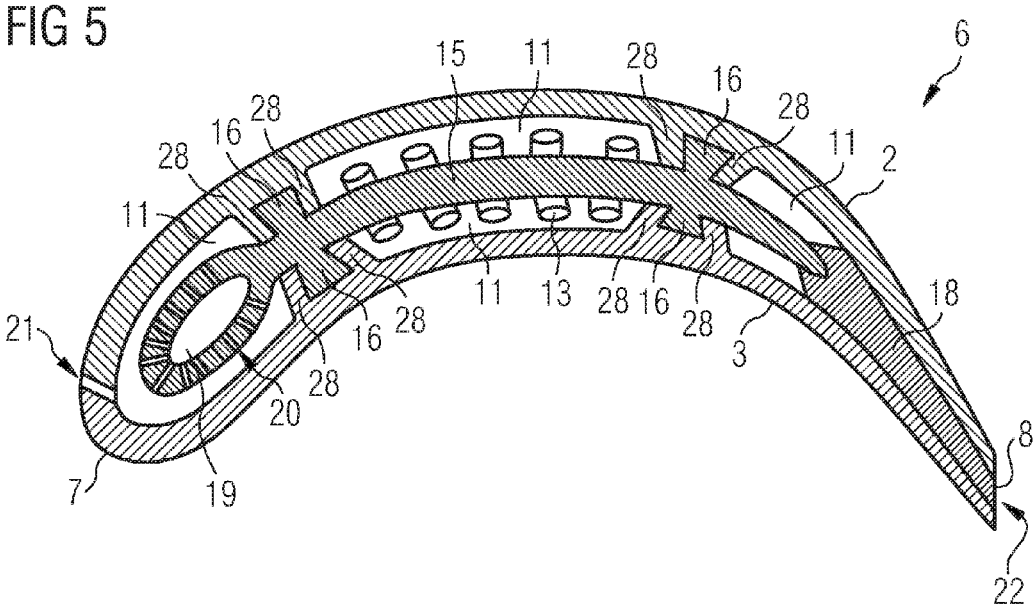
Figure 6:
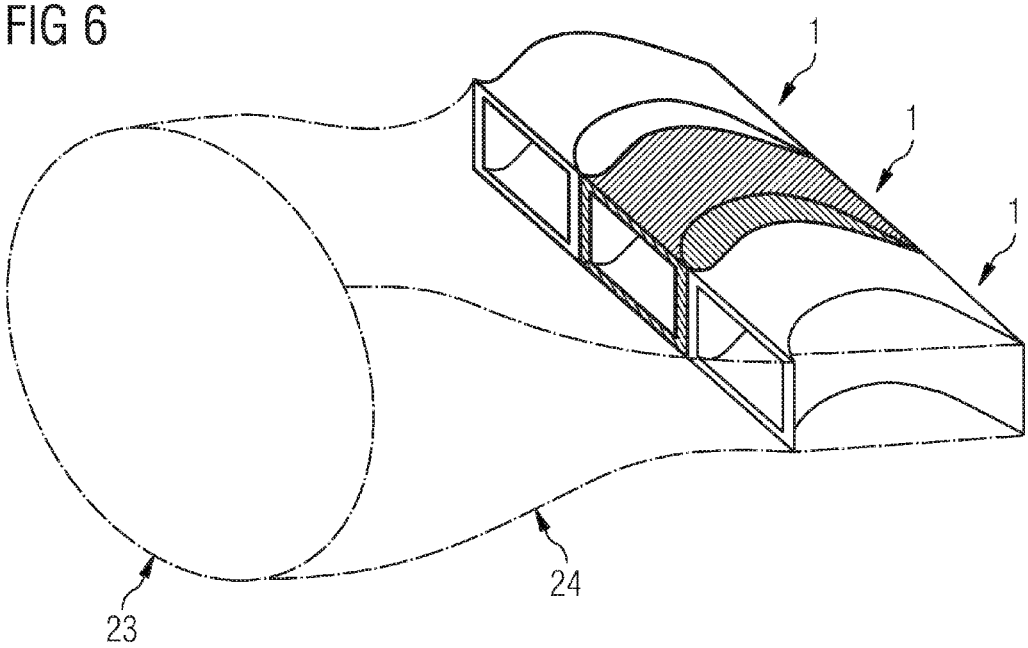
Figure 7:
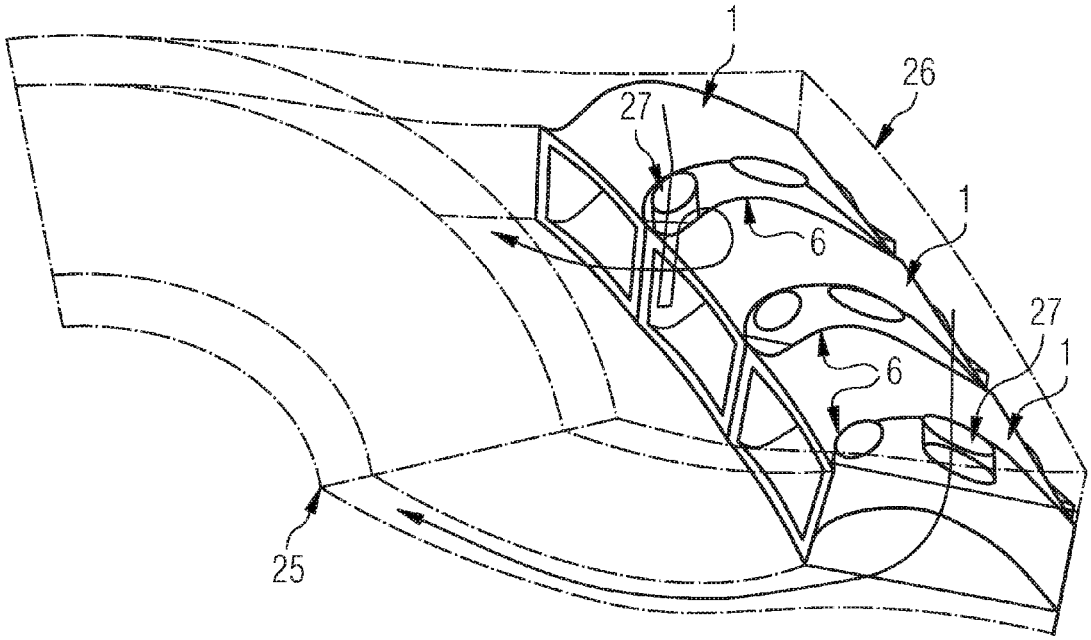
Figure 8:
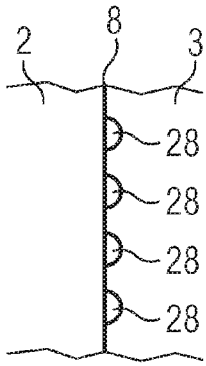

FIG. 3 shows a cross section of a guide vane formed by two adjoining guide vane duct elements, FIG. 4 shows a cross section of an alternative guide vane formed by two adjoining guide vane duct elements, FIG. 5 shows a cross section of an further alternative guide vane formed by two adjoining guide vane duct elements, FIG. 6 shows an arrangement of three adjoining guide vane duct elements integrated with a transition duct of a can combustor, FIG. 7 shows an arrangement of three adjoining guide vane duct elements integrated with a transition duct of a annular combustor, and FIG. 8 shows a view onto a trailing edge of a guide vane which includes a series of exit openings.

DETAILED DESCRIPTION OF THE PREFERRED EMBODIMENT OF THE INVENTION

Referring to FIGS. 1 to 5, a guide vane duct element 1 comprises a suction side wall 2, a pressure side wall 3, a hub segment wall 4 and a shroud segment wall 5. The pressure side wall 3 is arranged vis-á-vis the suction side wall 2 and the hub segment wall 4 is arranged vis-á-vis the shroud segment wall 5 such that said walls 2, 3, 4, 5 form a duct which serves as a flow passage 9.

Figure 1:
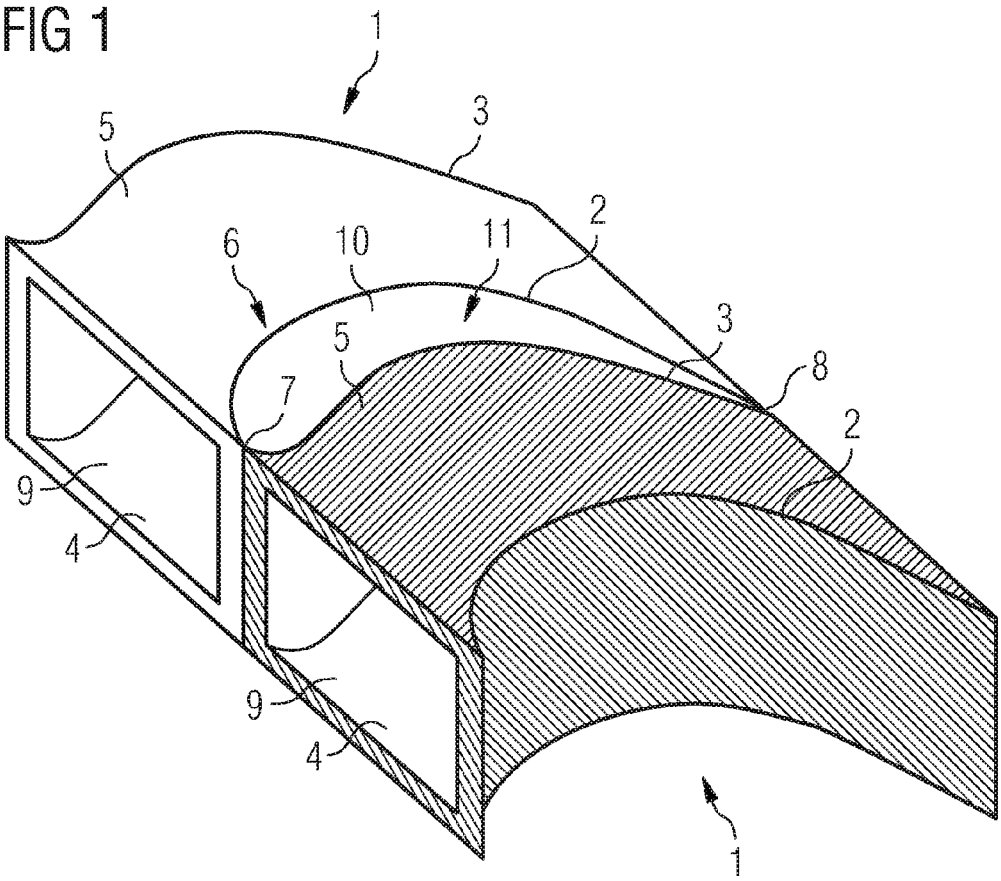
FIG. 1 shows a perspective view of two adjoining guide vane duct elements.

According to FIG. 1, two individual guide vane duct elements 1 are arranged side by side such that the suction side wall 2 of one guide vane duct element 1 and the pressure side wall 3 of the other guide vane duct element 1 are adjoining each other at least as some points thereby cooperating to form a guide vane 6. The guide vane 6 has a leading edge 7 and a trailing edge 8, each formed by mating the suction side wall 2 of one guide vane duct element 1 with the pressure side wall 3 of the other guide vane duct element 1.

Within the guide vane 6, i.e. between the suction side wall 2 of one guide vane duct element 1 and the pressure side wall 3 of the other guide vane duct element 1, a hollow interior 10 of the guide vane 6 is formed. Through the interior 10 cooling air can flow for the purpose of cooling the guide vane 6 during operation.

Figure 2:
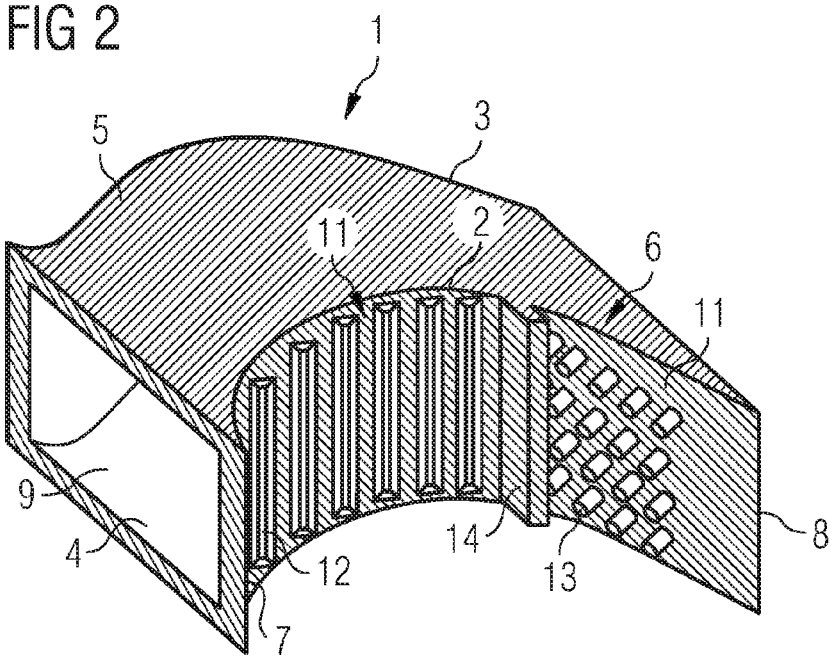
FIG. 2 shows a perspective view of the guide vane duct element.

As can be seen from FIG. 2, in order to direct and manipulate the cooling air flow within the interior 10, therein cooling passages 11 are formed. The cooling passages 11 are defined by ribs 12 provided on the suction side wall 2 within the interior 10 and extending parallel to the leading edge 7 and the trailing edge 8. Therefore, the ribs 12 guide the cooling air parallel thereto such that, for example, cooling air entering the interior 10 at the hub segment wall 4 is guided in direction to the shroud segment wall 5. The ribs 12 are arranged in a region located at the leading edge 7 and in a middle part of the guide vane 6.

Within the interior 10, at a rear region of the guide vane 6 and at the trailing edge 8, pedestal turbulators 13 are provided in order to mix the cooling air flow and to produce turbulence. Therefore, the heat transfer from the material of the guide vane 6 to the cooling air is increased. The area comprising the ribs 12 and the area comprising the pedestal turbulators 13 are separated by a separation wall 14. Analogous to the suction side wall 2, the ribs 12, separation wall 14 and the pedestal turbulators 13 are also provided on the pressure side wall 3, too.

When manufacturing the guide vane duct element 1, the pedestal turbulators 13 can be formed by hollow-bore milling cutter(s) or grinding "tube"(s). The ribs 12 can be manufactured by slot milling/grinding tools. Alternatively, chemical or electrical discharge machining from a negative master electrode could be applied. The cooling channels 11 can be sunk much closer to the aerodynamic surface of the suction side wall 2 and the pressure side wall 3, respectively, and made much finer, reducing the thermal impedance, whilst permitting deeper ribs 12 for more mechanical strength of the suction side wall 2 and the pressure side wall 3.

Alternatively, self-adapting turbulators can be provided in the interior 10. Due to the access of the interior 10 when manufacturing the guide vane duct element 1, said self-adapting turbulators can be easily attached.

FIGS. 3 to 5 show a cross section view of the guide vane 6. The guide vane 6 is formed by the suction side wall 2 of the one guide vane duct element 1 and the pressure side wall 3 of the other guide vane duct element 1. Within the interior 10 a key element 15 is arranged. The key element 15 comprises a side facing the pressure side wall 3 and a side facing the suction side wall 2. Both sides of the key element 15 are provided with two protrusions and the suction side wall 2 and the pressure side wall 3, respectively, are provided with webs 28 cooperating with the protrusions thereby forming two dovetails 16 at each side of the key element 15. The dovetails 16 extend parallel to the leading edge 7 and the trailing edge 8 thereby dividing the interior 10 into four cooling passages 11 extending from the hub segment wall 4 to the shroud segment wall 5.

Further, the one guide vane duct element 1 and the other guide vane duct element 1 are interlocked via the key element 15 by means of the dovetails 16. When mounting both guide vane duct elements 1, said both guide vane duct elements 1 have to be arranged side by side and the key element 15 has to be introduced into the interior 10 such that the protrusions engage between the respective webs thereby forming the dovetails 16. Therefore, the interlocking of the guide vane duct elements 1 is removable offering a quick way of removing individual guide vane duct elements 1 for localised repair, for example.

Further, either or both the mounting rings for the hub segment wall 4 and the shroud segment wall 5 could be provided to take a force transmitted through the key element 15 from aerodynamic surfaces of the suction side wall 2 and the pressure side wall 3.

The key element 15 is provided with pedestal turbulators 13 between the dovetails 16 the key element 15 and the leading edge portion of the key element 15 is provided with rib turbulators 17. Therefore, said turbulator features 13 and 17 are manufactured on the key element 15 whereas alternatively the suction side wall 2 and the pressure side wall 3 lack any turbulator features. This is in particular advantageous when the guide vane duct elements 1 are made of a material which is harder than that of the key element 15 in order to simplify and speed up production. Further, the geometry of the guide vane duct element 1 is advantageously simple.

Heat transfer will still take place by radiation from walls 2 and 3 to the key element and then extracted by flow around turbulators 13 and 17.

In order to form a multiple guide vane assembly several guide vane duct elements 1 and their key elements 15 can be bonded together by fusion or by diffusion means or by mechanical locking.

Alternatively, in the trailing edge portion of the interior 10 the suction side wall 2 is provided with pedestal turbulators 13 and the pressure side wall 3 is provided with rib turbulators 17. As a further alternative in the trailing edge portion of the interior 10 the suction side wall 2 and the pressure side wall 3 is provided with a rib comb 18 as turbulator (FIG. 5).

Alternatively, in the leading edge portion of the interior 10 into the key element 15 a impingement tube 19 is incorporated comprising impingement tube discharge openings 20 (FIG. 4, FIG. 5).

Further, at the leading edge 7 and at the trailing edge 8 the suction side wall 2 and the pressure side wall 3 mate and form a partitioning line.

The dovetails 16 are sized such that the key element 15 spaces the suction side wall 2 and the pressure side wall 3. Therefore, at the leading edge partitioning line the guide vane 6 is formed with a leading edge slot 21, as shown in FIGS. 3 to 5. Further, at the trailing edge partitioning line the guide vane 6 is formed with a trailing edge slot 22, as shown in FIG. 5.

The leading edge slot 21 and the trailing edge slot 22 connect the cooling passage 11 with the flow passage 9 such that cooling air can flow from the cooling passage 11 in the interior 10 of the guide vane 6 to the outside into the flow passage 9.

Since the partition lines are accessible from the outside when handling the individual guide vane duct element 1 during manufacture, for example, accurate machining of the leading edge slot 21 and/or of the trailing edge slot 22 is simple. In particular, the leading edge slot 21 and/or the trailing edge slot 22 can be made with a smooth internal edge, thereby reducing the flow resistance of the slots 21 and 22 and increasing the through flow of cooling air and reducing variability of the flow through adjacent vanes. Further, the trailing edge 8 of the guide vane 6 is made sharper, thereby reducing thermodynamic and aerodynamic losses and limiting downstream disturbances.

The leading edge slot 21 is located in the curvature of the leading edge 7 in direction to the suction side of the guide vane 6. When cooling air flows from the interior 10 via the leading edge slot 21 to the flow passage 9, cooling air is transported on the suction side of the suction side of the guide vane 6 with a cooling effect. Therefore, by means of the leading edge slot 21 a film-layer cooling of the guide vane can be performed. Alternatively the passage can discharge to the pressure side wall.

As an alternative to a slot the partition line can be provided with a plurality of depressions 28 on the pressure side wall 3 and/or the suction side wall 2. FIG. 8 shows, in a view onto the trailing edge, an embodiment with depressions 28 in the pressure side wall 3. The depressions 28 form a series of openings in the leading edge and/or the trailing edge for the discharge of cooling air.

Further, cooling air enters from the interior 10 of the guide vane 6 into the flow behind trailing edge 8. Thereby the wake region of the guide vane is advantageously energised. Therefore the aerodynamics being experienced by downstream blades is improved, particularly with respect to vibratory flow regimes.

As can be seen in FIG. 6, three guide vane duct elements 1 are integrated with a transition duct 24 of a can combustor 23.

Since the position of each guide vane duct element 1 is fixed relative to the combustor 23, different cooling patterns could be machined into the same basic part of the guide vane duct element 1 before assembly and bonding to account for known variation in temperature profile issuing from the burners. This allows a reduction of overall cooling air flow. In this case, the middle guide vane duct element 1 has an alternative machined cooling scheme to cope with hot-spot, for example.

FIG. 7 shows an arrangement of three guide vane duct elements 1 with an annular combustor 25 comprising an outer cooling shell 26. The guide vane 6 comprises cooling passage ports 27 for entering the cooling air into the cooling passages 11 of the guide vanes 6. The outer cooling shell 26 is constructed to carry back cooling air discharging the guide vanes 6 back to a burner for reuse (see arrows in FIG. 7 indicating the flow of the cooling air). Alternatively flow could enter from outer passages and return to the burner by inlet passages.

The invention inverts the current geometry for manufacturing hot gas turbine stationary blading, bringing a host performance, production and service advantages and hitherto design freedom to optimise cooling usage with a direct impact on engine power output and efficiency.

Furthermore, the greater predictability of part life due to better geometry tolerances achievable via improved manufacturing access should also improve forced outage rates.

The invention claimed is:

1. An inlet guide vane arrangement for a gas turbine comprising:

a plurality of guide vane duct elements, each guide vane duct element, comprising:

a suction side wall, and a pressure side wall, wherein the suction side wall and the pressure side wall of each guide vane element face each other, wherein adjoining guide vane duct elements are placed side by side such that the pressure side wall of one guide vane duct element cooperates with the suction side wall of the adjacent guide vane duct element thereby forming a guide vane, wherein a key element is inserted within a hollow interior of each guide vane between the pressure side wall and the adjacent suction side wall when two guide vane duct elements adjoin one another, and wherein the key element attaches both adjoining guide vane duct elements together, wherein the key element includes a first side facing the suction side wall and a second side wall facing the pressure side wall, wherein each side is provided with two protrusions, wherein the suction side wall and the pressure side wall each include a web whereby when key element is introduced between two adjoining guide vane duct elements the webs cooperate with the protrusions forming two dovetails on each side of the key element which interlock the adjoining guide vane duct elements, and wherein each dovetail extends parallel to the leading edge and the trailing edge thereby dividing the hollow interior into four cooling passages.

2. The arrangement as claimed in claim 1, wherein each guide vane duct element further comprises a hub segment wall and a shroud segment wall facing each other and forming a hub or a shroud annulus of a guide vane row, respectively, when the plurality of guide vane duct elements are arranged next to one another.

3. The arrangement as claimed in claim 2, wherein both the hub segment wall and the shroud segment wall have a predetermined extension upstream from a leading edge of the guide vane and downstream of a trailing edge of the guide vane.

4. The arrangement as claimed in claim 1, wherein the plurality of guide vane duct elements are made of a high temperature material.

5. The arrangement as claimed in claim 4, wherein the plurality of guide vane duct elements are made of a ceramic material or a metal alloy.

6. The arrangement as claimed in claim 1, wherein each guide vane duct element is manufactured by pressing or forging the guide vane duct element out of a sheet or plate material, and wherein each guide vane is either preformed as a single piece or in two halves which are subsequently joined together.

7. The arrangement as claimed in claim 6, wherein the two halves are joined together by a fusion weld.

8. The arrangement as claimed in claim 6, wherein the two halves are joined together on the hub segment wall and the shroud segment wall between the suction side wall and the pressure side wall.

9. The arrangement as claimed in claim 1, wherein the guide vane duct element includes a coating.

10. The arrangement as claimed in claim 1, wherein the guide vane comprises, when assembled, a hollow interior adapted for air cooling, and wherein the hollow interior includes a plurality of turbulators.

11. The arrangement as claimed in claim 10, wherein a plurality of cooling passages are located within the hollow interior, and wherein the plurality of cooling passages are defined by a plurality of ribs provided on the suction side wall within the hollow interior and extending parallel to the leading edge and to the trailing edge.

12. The arrangement as claimed in claim 1, wherein the key element is attached to the pressure side wall and the corresponding suction side wall by a form fit.

13. The arrangement as claimed in claim 1, wherein the key element includes a plurality of turbulators and/or an impingement tube.

14. The arrangement as claimed in claim 1, wherein when two guide vane duct elements are adjoining by the pressure side wall of one guide vane duct element and the suction side wall of the adjacent guide vane duct element at the leading edge and/or at the trailing edge, a partitioning line is defined including a leading edge opening and/or a trailing edge opening, respectively.

15. The arrangement as claimed in claim 14, wherein the key element is adapted to distance the pressure side wall from the adjacent suction side wall such that the leading edge opening and/or the trailing edge opening are formed as an aerodynamic slot and is permeable between the flow passage and the hollow interior.

16. The arrangement according to claim 14, wherein the partitioning line between adjacent guide vanes elements defines a joined location as well as a plurality of leading edge openings and/or a plurality of trailing edge openings formed as a series of discrete holes.

17. The arrangement as claimed in claim 1, wherein when forming a multiple guide vane assembly, a plurality of guide vane elements with corresponding plurality of key elements are bonded together by fusion, or by a diffusion process, or by a mechanical locking.

18. The arrangement as claimed in claim 1, wherein the plurality of guide vanes are attached to a combustor exit.

* * * * *